US005266160A

United States Patent [19]

Henricson et al.

[11] Patent Number: 5,266,160

[45] Date of Patent: Nov. 30, 1993

[54] METHOD OF AN APPARATUS FOR TREATING PULP

[75] Inventors: Kaj O. Henricson, Kotka; Toivo Niskanen, Hamina, both of Finland

[73] Assignee: Kamyr, Inc., Glens Falls, N.Y.

[21] Appl. No.: 772,362

[22] PCT Filed: Mar. 29, 1990

[86] PCT No.: PCT/FI90/00085

§ 371 Date: Nov. 6, 1991

§ 102(e) Date: Nov. 6, 1991

[87] PCT Pub. No.: WO90/13344

PCT Pub. Date: Nov. 15, 1990

[30] Foreign Application Priority Data

May 10, 1989 [FI] Finland ..... 892243

[51] Int. Cl.[5] ..... B01D 19/00

[52] U.S. Cl. ..... 162/57; 96/217; 95/261

[58] Field of Search ..... 55/203, 36; 68/181 R; 8/156; 162/55, 57, 29, 67; 415/169.1

[56] References Cited

U.S. PATENT DOCUMENTS

| | | | |
|---|---|---|---|
| 3,832,276 | 8/1974 | Roymoulik et al. | 162/65 |
| 4,209,359 | 6/1980 | Sethy | 162/29 |
| 4,410,337 | 10/1983 | Gullichsen et al. | 55/21 |
| 4,435,193 | 3/1984 | Gullichsen | 55/203 |
| 4,826,398 | 5/1989 | Gullichsen | 55/203 |
| 4,886,577 | 12/1989 | Wiley | 162/52 |

FOREIGN PATENT DOCUMENTS

| | | | |
|---|---|---|---|
| 0067148 | 4/1982 | European Pat. Off. . | |
| 0330387 | 8/1989 | European Pat. Off. . | |
| 0397308 | 11/1990 | European Pat. Off. | 162/65 B |
| 8600542 | 1/1986 | PCT Int'l Appl. | 55/203 |

OTHER PUBLICATIONS

Kurtz, K. D., 1978 TAPPI Engineering Conference (Sep. 1978) pp. 349-357.

*Primary Examiner*—W. Gary Jones
*Assistant Examiner*—Brenda Lamb
*Attorney, Agent, or Firm*—Nixon & Vanderhye

[57] ABSTRACT

The present invention relates to a method of and an apparatus for treating pulp. The apparatus according to the present invention is especially suitable for carrying out bleaching processes of the wood processing industry and for separation of residual gases remaining in the suspension in the processes. The method of the present invention is characterized in that pulp at the consistency range of 8 to 20% is subjected to at least the following treatment steps in a closed pressurized process: feeding pulp with a pump to a chemical mixer; mixing chemicals with the pulp; introducing the pulp flow by means of the pressure of the pump to a process vessel; treating the pulp with chemicals in the process vessel; removing gases from the pulp in connection with the process vessel or after it in a closed pressurized separator; in the gas separation, preventing fibers from exiting with the gas; and guiding the pulp via a closed path to a following process step. The apparatus according to the present invention is in turn characterized in that the rotor (10) preferably comprises a rotationally symmetric shell (110) which is centrally mounted on a flange (20) disposed substantially perpendicular to the shaft (12) of the rotor (10), and the end of which adjacent to the flange (20) has openings (112) for removal of the gas-free suspension towards the outlet (58).

29 Claims, 6 Drawing Sheets

METHOD OF AN APPARATUS FOR TREATING PULP

FIELD OF THE INVENTION

The present invention relates to a method of and an apparatus for treating pulp, preferably in a closed process. The method according to the invention is particularly well applicable in chemical processes of the wood processing industry for reducing the environmental damages thereof. More specifically, the apparatus according to the present invention is suitable for separation of residual gases remaining in the fiber suspensions of the wood processing industry after a bleaching process. In addition to its main use, which is degassing, a preferred embodiment of the invention can further be employed in the discharge of fiber suspension from a bleaching tower.

PRIOR ART

A number of degassing devices are known for removing residual gases remaining in the fiber suspension after a bleaching stage. U.S. Pat. No. 4,209,359, of 1980, discloses a process of separating residual oxygen from a pulp bleached with oxygen. The separation device according to the patent is quite a large vessel into which the pulp is discharged from a bleaching stage and in which the pulp is treated at the consistency of approx. 3%. The pulp is introduced into the vessel tangentially which subjects the pulp to a centrifugal force promoting separation of gas in a way know per se in such a way that part of the gas can be removed directly from this stage. After that the pulp is allowed to flow to the bottom of the vessel where it is agitated for times of about 30 seconds to 5 minutes with two mixers of different types, the upper one of which is employed to pump the pulp axially downwards and the lower one radially outwards which creates a vortex flow in the pulp which separates residual gas from the pulp.

The drawback of the above apparatus is that the pulp must be diluted to a low consistency only in order to separate the gas. It is a known fact that the most advantageous consistency of pulp for the bleaching is in the range from about 10% to about 12%. After this the bleached pulp is taken either directly or via degassing to a washing plant. If residual gas is not separated from the bleached pulp prior to washing the gas in the pulp will impede the washing and will substantially impair the washing result. If the pulp must be diluted for the degassing process prior to washing, remarkably larger amounts of liquid must be used in the washing than at the original consistency. For example, if the consistency is 3% there is approx. 30 kg free water per 1 kg fiber in the pulp. When the consistency is 12% the amount of free water is only about 5 kg per 1 kg fiber. Thus, if the consistency is quadrupled the amount of free water is one sixth, only, of the amount of free water present in the low consistency. Diluting the pulp thus means that six times the amount of water required by undiluted pulp must unnecessarily be pumped to the washer. Further, the solution of the presented specification comprises several spaces open to the surrounding atmosphere which means that the pulp is not treated in a pressurized closed hydraulic space. FIG. 6 illustrating the process of the patent specification discloses that a bleaching tower 36, a gas separator 10 and a filter 46 are open pressureless devices. These involve contact between air and the pulp and thus problems with foam and smell. The object of the present invention is to eliminate the problems of the apparatus according to the U.S. Pat. No. 4,209,359. In the apparatus of the present invention, the pulp is treated in an airless closed space.

U.S. Pat. No. 4,362,536 discloses a device for removing gas from a pulp flowing in a pipe before the pulp freely drops to a pulp vessel. Gas is separated by introducing the pulp tangentially to a separator in which a rotating rotor increases the rotating speed of the pulp and the centrifugal force separates the gas to the center of the device wherefrom it is removed. Barrier plates are used to prevent the pulp from flowing out with the gas. The rotor has not been designed to raise the pressure of the pulp to be treated as an increase of pressure is not needed because the pulp drops freely down to a vessel. The apparatus can not be used in a closed process which requires a controlled gas discharge tolerating pressure fluctuations and a pressurized pulp discharge. Further, the correct pressure difference between the supplied pulp, the discharged pulp and the discharged gas must be maintained. It is also an advantage if the pressure of the pulp discharged can be raised in the gas separator which allows a lower pressure in the reaction vessel and thus reduces the investment costs.

DISCLOSURE OF THE INVENTION

The present invention overcomes the drawbacks of both the prior art devices described above and the methods applied in them. It is a characteristic feature of the method and the apparatus of the present invention that gas can be separated from a pulp of medium consistency by installing an apparatus of the invention in the outlet of a closed reactor and the apparatus itself takes care of the discharge of the reactor, separation of gas in a way which tolerates pressure fluctuations, and supplies pulp further at a raised pressure. Due to its structure, the apparatus is capable of separating gas in such a way that there are no pulp fibers entrained in it even if the pressure in the pulp vessel varies. Thus, the operation of the apparatus is both separation and cleaning of gas. The fiber material separated in the gas cleaning is recycled via the gas separator to the pulp flow. A feature of a preferred embodiment of the gas separator is that it is able to raise the pressure of the pulp discharged.

The method of the present invention is characterized in that pulp of a consistency range of 8 to 20% is subjected to at least the following treatment steps in a closed pressurized process:

- feeding pulp with a pump to a chemical mixer;
- mixing chemicals with the pulp;
- introducing the pulp flow by means of the pressure of the pump to a process vessel;
- treating the pulp with chemicals in the process vessel;
- removing gases from the pulp in connection with the process vessel or after it in a closed pressurized separator;
- in the gas separation, preventing fibers from exiting with the gas; and
- guiding the pulp via a closed path to a following process step.

The apparatus according to the present invention is in turn characterized in that the rotor preferably comprises a rotationally symmetric shell which is centrally mounted in a flange disposed substantially perpendicular to the shaft of the rotor, said shell having openings at the end adjacent to the flange for discharging the gas-free suspension towards an outlet.

BRIEF DESCRIPTION OF THE DRAWINGS

The method and the apparatus of the present invention are described in more detail below with reference to the accompanying drawings, in which.

DETAILED DESCRIPTION OF PREFERRED EMBODIMENTS

Figure 1:
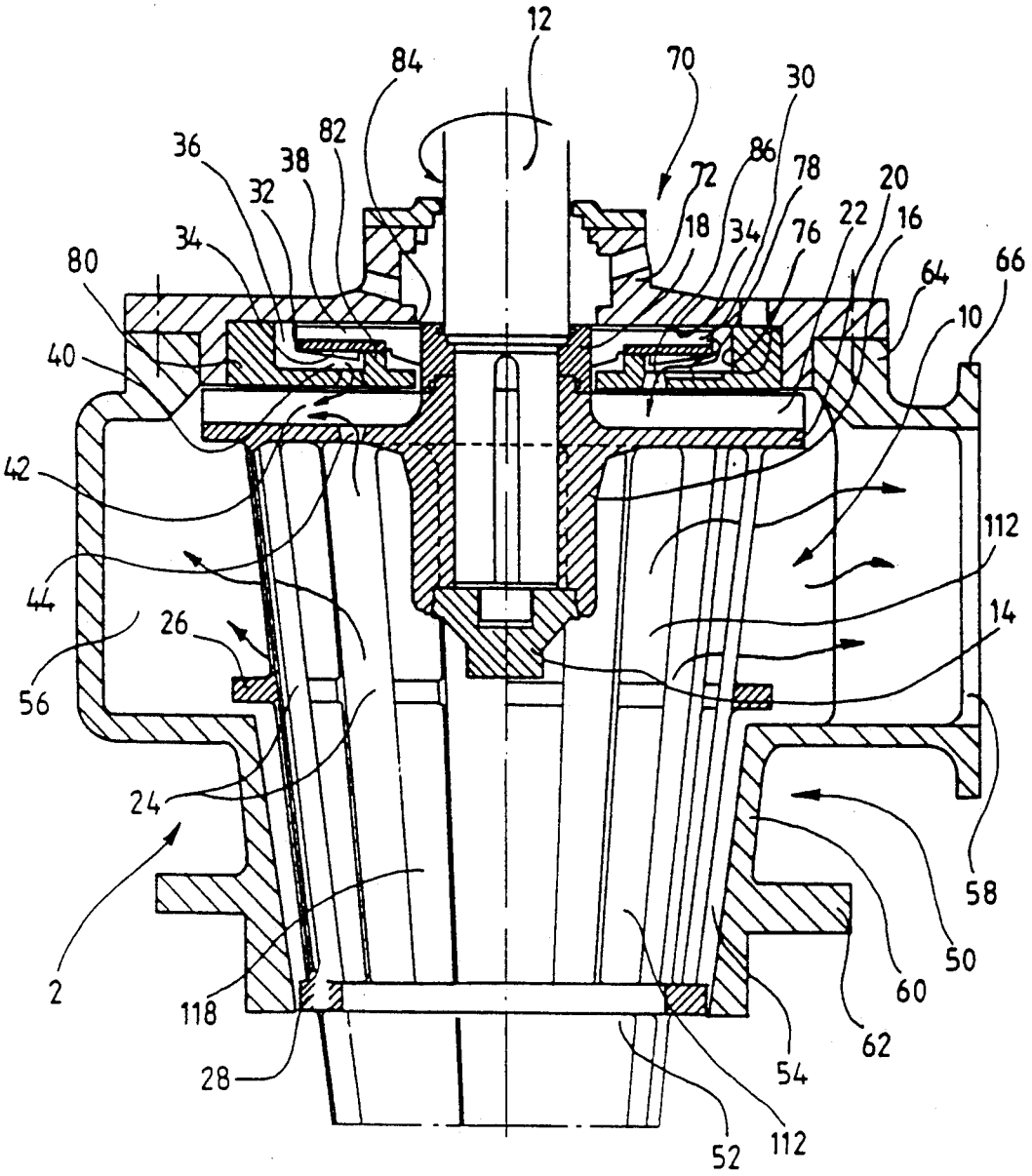
FIG. 1 illustrates a preferred embodiment of the apparatus according to the invention.

As illustrated in FIG. 1, a gas separator 2 according to the invention comprises three main parts: a rotor 10, a rotor casing 50, and a body 70 of the separator. In the embodiment according to FIG. 1, the rotor 10 comprises a first sleeve 16 connected to a shaft 12 by a screw 14 or a corresponding means, and a second sleeve 18. A flange 20 projects substantially in the radial direction from the sleeve 16. A number of back blades 22 rotating in a so-called second separation chamber are fixed to the other side, i.e. to the back side of the flange. To the front side of the flange 20 at a distance from the sleeve 16, a number of blades 24 are fixed which are nearly perpendicular to the flange 20 and are preferably supported by support rings 26 and 28 in such a way that the diameter of the rim at which the blades 24 are fixed to the flange is longer than the diameter of the supporting rings 26 and 28. In other words, the blades preferably form a conical cage 118 tapering in the direction away from the flange 20. An typical feature of the cage 118 is that its center is fully open except for the hub of the rotor (cf. screw 14), and that there are openings 112 between the blades at the rotor end adjacent to the flange via which openings 112 the pulp flows out of the rotor 10. The number of the blades 24 can vary greatly, e.g. between 6 and 18 but preferably the number is 12. In the embodiment illustrated in the drawing, part of the blades—e.g. if the total number of the blades is 12, four of them—are a little longer than the others. The cross section of the blades resembles preferably the one illustrated in FIG. 3 , i.e. the cross section is substantially an isosceles triangle the relatively narrow base of which is the front surface of the blade leading in the direction of rotation of the blade and the sides of the triangle constitute the other surfaces of the blade. Naturally, the shape of the cross section of the blades can be very different from the one illustrated but tests have proved that the shape presented is very successful. The typical feature of the blades is that their dimension in the radial direction is rather small, preferably less than 10% of the diameter of the rotor. The reason for this is that the blades of this type are able to give the suspension an adequately high rotating velocity without, however, consuming much energy.

There are a number of blades 30 extending substantially radially outwards from the second sleeve 18 of the rotor 10. To the front surface (facing flange 20) of said blades 30, which surface is substantially perpendicular to the shaft 12, at a distance from the sleeve 18, a disc 32 is provided, and to the front side of the disc 32 a second series of substantially radial blades 34 the dimensions of which are, however, remarkably smaller than the dimensions of the blades 30. The blades 30 and 34 and the disc 32 are arranged to rotate in a chamber 36 of their own, which is a so-called third separation chamber divided by the disc 32 in two chamber portions 38 and 40, the chamber 36 being separated from the rest of the rotor space by an intermediate wall which is a part of the separator body. Thus blades 30 rotate in the chamber 38 and blades 34 in the chamber 40.

The casing 50 of the rotor 10 comprises an axial inlet 52 which continues as an inlet duct 54, substantially complying with the shape of the rotor 10, towards a preferably spiral chamber 56 which is provided with an outlet 58 in a plane substantially perpendicular to the shaft 12. The inlet duct 54 and the spiral chamber 56 form a so-called first separation chamber. The clearance between the inner wall of the inlet duct 54 and the rotor blades 24 is in the range of 5 to 50 mm depending largly on the other dimensions of the gas separator; preferably said clearance is in the range of 10 mm. There is a flange 62 disposed in the outer wall 60 of the inlet duct 54 by means of which flange the gas separator can be fixed either to a pipe line, a bleaching tower or any other suitable place. In the embodiment of the figure, the rotor support ring 28, which is the outer ring relative to the flange 20, is located in the inlet 52 of the casing 50. However, it is possible that said support ring is located either in the inlet duct 54 or correspondingly outside the inlet 52. In most cases, however, there are reasons for providing the support ring 28 in the location illustrated in the figure whereby the longer blades 24 clearly extend outside the inlet and the blades 24 still are steadily supported by the ring 28.

The casing 50 preferably ends by an annular flange 64 at the flange 20 of the rotor 10. The inner diameter of the flange 64 is longer than the diameters of the flange 20 and the support rings 26 and 28 so as to allow pulling of the rotor 10 out of the casing 50 as one unit. Preferably there is also a flange 66 provided around the outlet 58 at which flange the gas separator is fixed to a pipe line or a corresponding arrangement.

The body 70 of the gas separator 2 comprises a back plate 72, which is fixed to the annular flange 64 and provided with a sealing and bearings (not illustrated) for the shaft 12 of the rotor 10. Further, the back plate 72 serves as the back wall 74 of the blade-disc-blade combination chamber 36. The periphery 76 and the front wall 78 of the chamber 36 are formed by a machined annular disc 80 which in the radial direction inwardly of the blades 34 but at a distance from the second sleeve 18 is provided with a ring 82 extending inside the chamber 36 close to the surface of the disc 32. The function of the ring 82 is to prevent the medium in the chamber 40 from flowing to the space between the disc 32 and the sleeve 18.

There is a gas outlet 84 in the back wall 74, i.e. in the back plate 72 of the chamber 36, close to the sleeve 18, which outlet can be an annular opening between the back plate 72 and the second sleeve 18. Correspondingly, there is an opening 86 provided in the front wall 78 of the chamber 36 radially outside of the ring 82, which opening leads to a space 42, a so-called second separation chamber, defined by the back blades 22 of the rotor and the front wall 78 of the chamber 36. Further, there is a flow passage 44 provided in the flange 20 of the rotor 10 or in the first sleeve 16 for passing the gas separated by the rotor to the space 42.

An apparatus according to the invention is employed in a preferred application by mounting the apparatus in the outlet of a reaction vessel in such a way that the longer blades of the rotor extend inside of the vessel to be able to mix the pulp, the consistency of which in many cases can be very high, in the vessel which causes the pulp to flow with the pressure of the vessel via the inlet 52 of the separator to the inlet duct in which the pulp is subjected to the rotating effect of the rotor. As the rotor is able to increase the rotating velocity of the pulp almost as high as its own rotating speed and as the rotor creates some turbulence in the pulp the pulp does not rotate as a uniform plug. This results in that, due to the centrifugal force, the pulp can more freely be pressed against the rotor and form an annular layer whereby the gas separating from the pulp has ideal conditions for collecting into bubbles and drifting towards a lower pressure in the center of the rotor. At the same time the rotational energy supplied by the rotor to the pulp and the centrifugal force created by it allow raising the pressure of the pulp in the outlet 58 compared to the pressure in the inlet 52. As the pressure is lowest by the flange 20 around the sleeve 16, gas is collected there and flows therefrom via the flow passage 44 to the space 42 behind the flange 20. Also some pulp drifts with the gas to the space 42 where the back blades 22 are provided to pump the pulp flown into the space 42 back to the spiral chamber 56. The gas drifts from the space 42, either due to the pressure prevailing in the space or due to suction connected to the gas separation system, via the opening between the annular disc 80 and the second sleeve 18 to the action range of the blades 30 and further via the gas discharge opening provided close to the sleeve 18 either straight to the atmosphere or, if further treatment of the gas is desired, to a treatment device or a collecting system. The function of the blades 30 is to ensure that if pulp is still transported with the gas flow via the opening between the annular disc 80 and the sleeve 18 to the chamber 36, the blades 30 pump the pulp via the chamber portion 38 around the outer edge of the disc 32 to the chamber portion 40 and therefrom further via the opening 86 to the space 42 wherefrom the back blades 22 further transport the pulp to the spiral chamber 56. The blades 30 in the chamber portion 38 generate a higher pressure than the pressure prevailing in the chamber 42 at the opening 86 which results in that the blades 30 in actual fact return the pulp via the chamber 40 to the chamber 42. The function of the blades 34 is only to prevent the pulp drifting into the chamber portion 40 from concentrating and forming lumps in the chamber portion 40 by generating weak turbulence in the pulp in the chamber portion 40. Further, the purpose of the blades 30 and 34 is to make the gas separator as unresponsive as possible to the pressure fluctuations in the spiral chamber or in the inlet duct, in other words to ensure that the gas discharge passage from the gas separator is always open and no fibres can in any circumstances entrain to the gas outlet 84 of the back plate 72.

Figure 2:
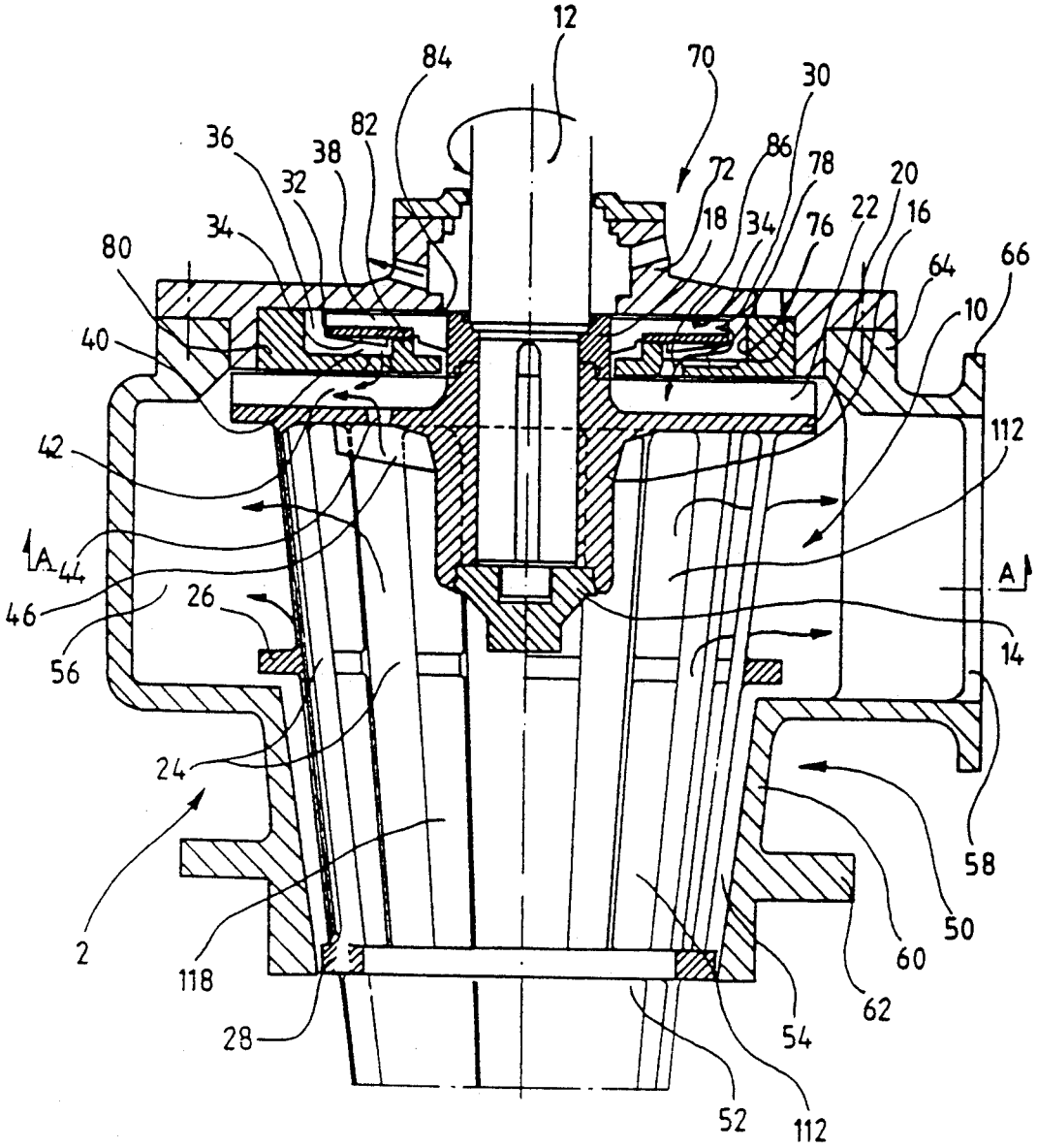
FIG. 2 illustrates another preferred embodiment of the apparatus according to the invention.

FIG. 2 illustrates a gas separator 2 according to another preferred embodiment of the invention, which separator is in principle similar to the apparatus illustrated in FIG. 1 with the exception of flange 20. In the apparatus of FIG. 2, the front surface of the flange, i.e. the surface facing the blades 24, is provided with a few blades 46. The structure and the operation principle of the blades 46 correspond to those of the blades of a centrifugal pump. Their function is to feed pulp from the cage formed by the blades 24 towards the spiral chamber 56 and further towards the outlet 58. By increasing the number or the length of these blades, the pressure-raising effect of the gas separator can be increased which is applicable e.g. when the apparatus is used as a discharger of a bleaching tower and the bleached pulp is supplied directly to a washer.

Figure 3:
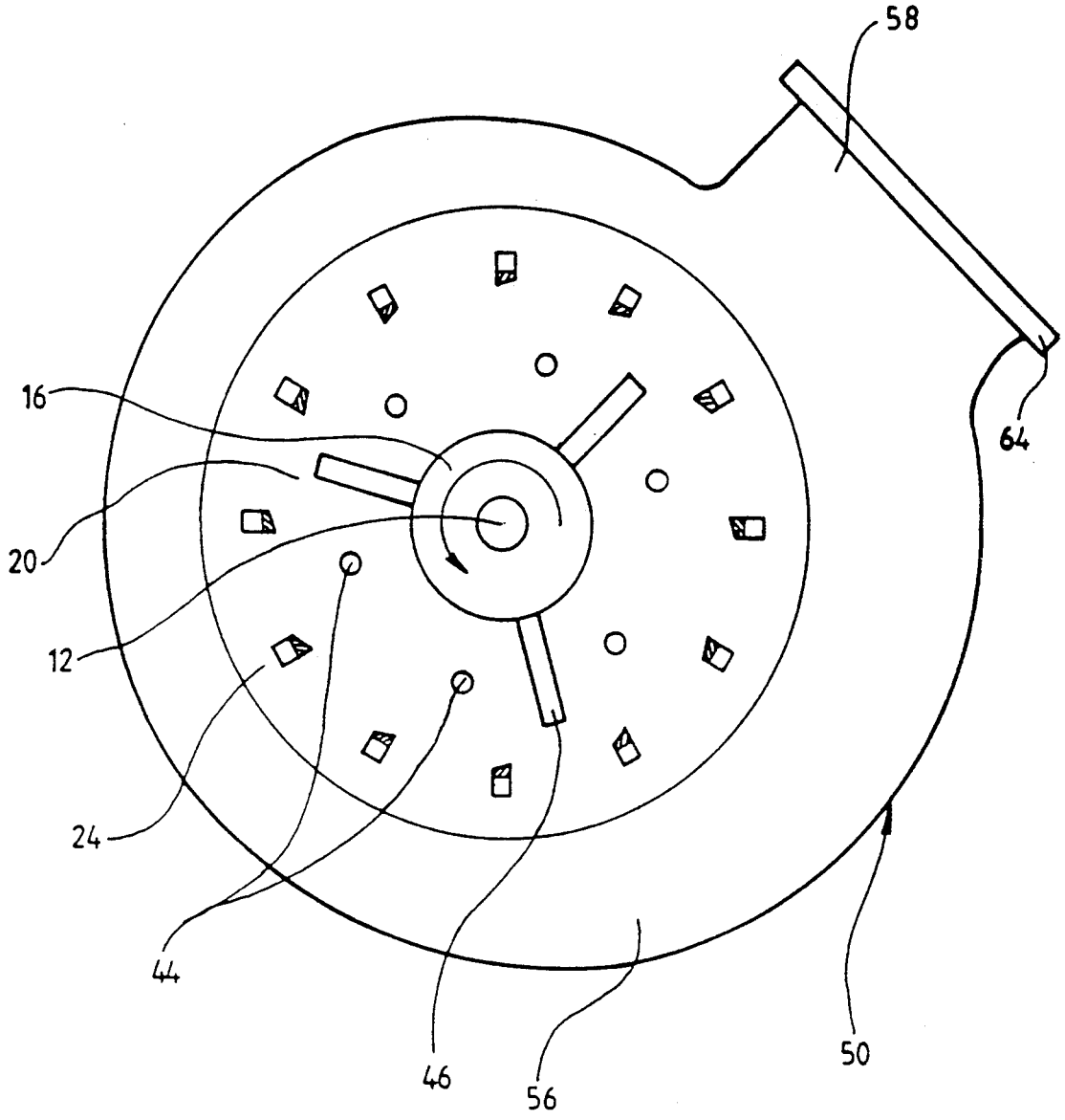
FIG. 3 is a section along line A—A of the embodiment of FIG. 1.

FIG. 3 illustrates the gas separator 2 of FIG. 2 in section along line A—A. The figure indicates the cross-sectional form of the blades 24 which already has been presented in connection with the description of FIG. 1. The figure also discloses the form of the pumping blades 46 and their number which in the case of the figure is three but can vary between 1 and 8. Correspondingly, the length of the blades 46 can vary from guite short blades which only slightly project outwards from the sleeve 16, to long blades extending to the outer edge of the flange 20. The blades 46 are chosen according to their conditions of use to optimize the pumping efficiency and to avoid unnecessary consumption of energy.

Figure 4:
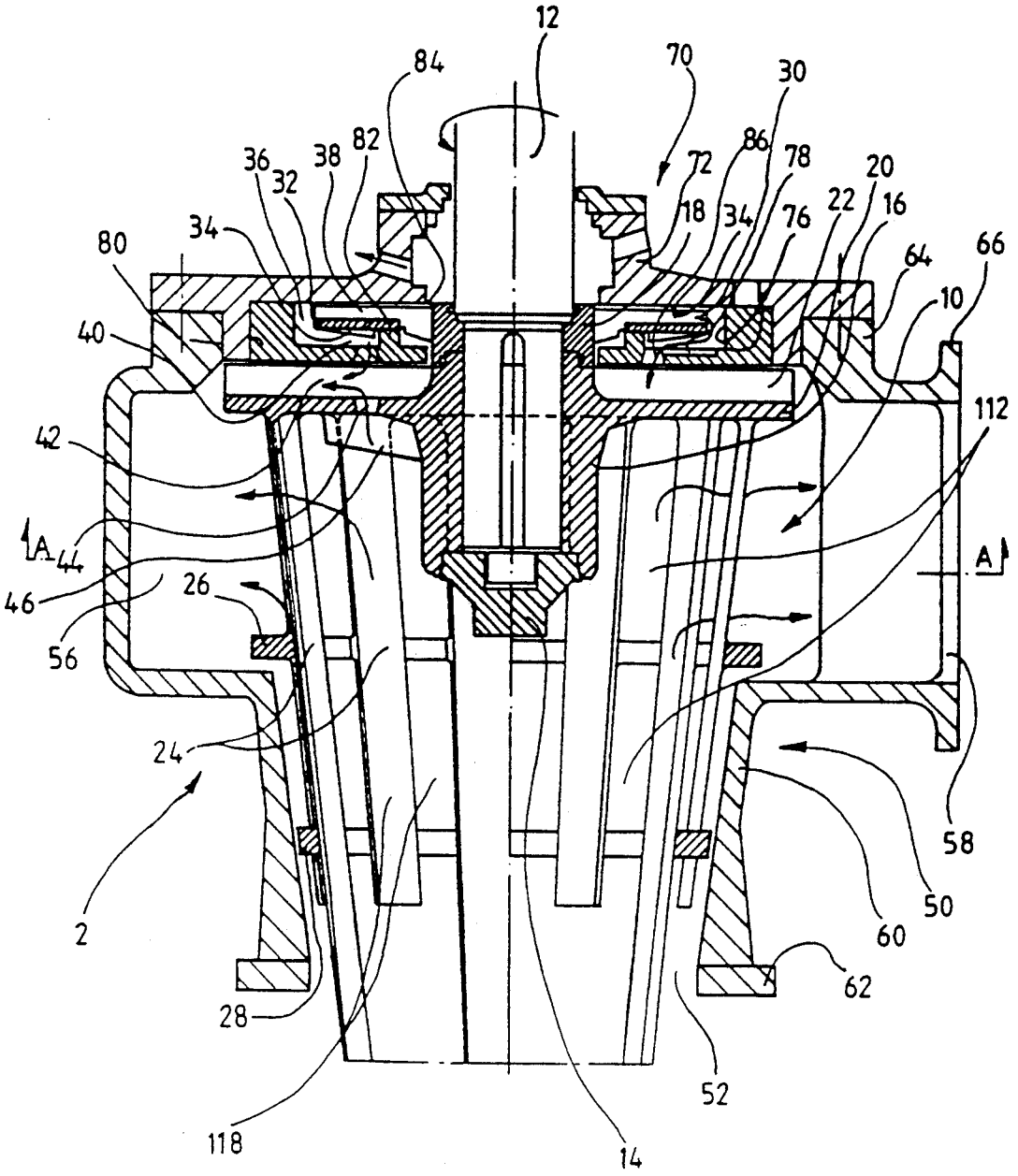
FIG. 4 illustrates a third preferred embodiment of the apparatus according to the invention.

FIG. 4 illustrates a gas separator 2 according to a third preferred embodiment of the invention, which mainly corresponds to the embodiment illustrated in FIG. 2 but in which all the blades 24 are of equal length and the support ring 18 closest to the ends of the blades is located at a distance from the ends of the blades. Also the location of the flange 62 of the inlet duct 54 is somewhat different, here it is situated around the inlet 52. The structure illustrated in this figure is very suitable for direct connection to a pipe line. Of course one must note that even in this case only part of the blades 24 can extend past the support ring 28.

Performed tests have proved that a gas separator having three pumping blades 46 can raise the pressure of a pulp of the consistency of 10 to 12% approximately 2 bars at the same time as practically all the residual gas contained in the pulp is removed. The test have also shown that the gas separator tolerates pressure fluctuations of $\pm 1$ bar with no fibers resulting in the discharged gases. At the same time the separator is able to discharge the tower without a separate discharger. The number of revolutions of the rotor used in the test varied within the range of 1200 to 1500 rpm. As the practical dimensioning principle of a gas separator can be considered the capability of the centrifugal force generated by the separator, i.e. the pressure raised by the separator, together with the pressure of the reaction vessel to overcome the counter pressure of the pipe line. The separation of gas to the center of the apparatus is always successful when the pressure difference over the gas separation can be thus adjusted so that the remaining fluctuation is less than the one tolerated by the separator.

Figure 5:
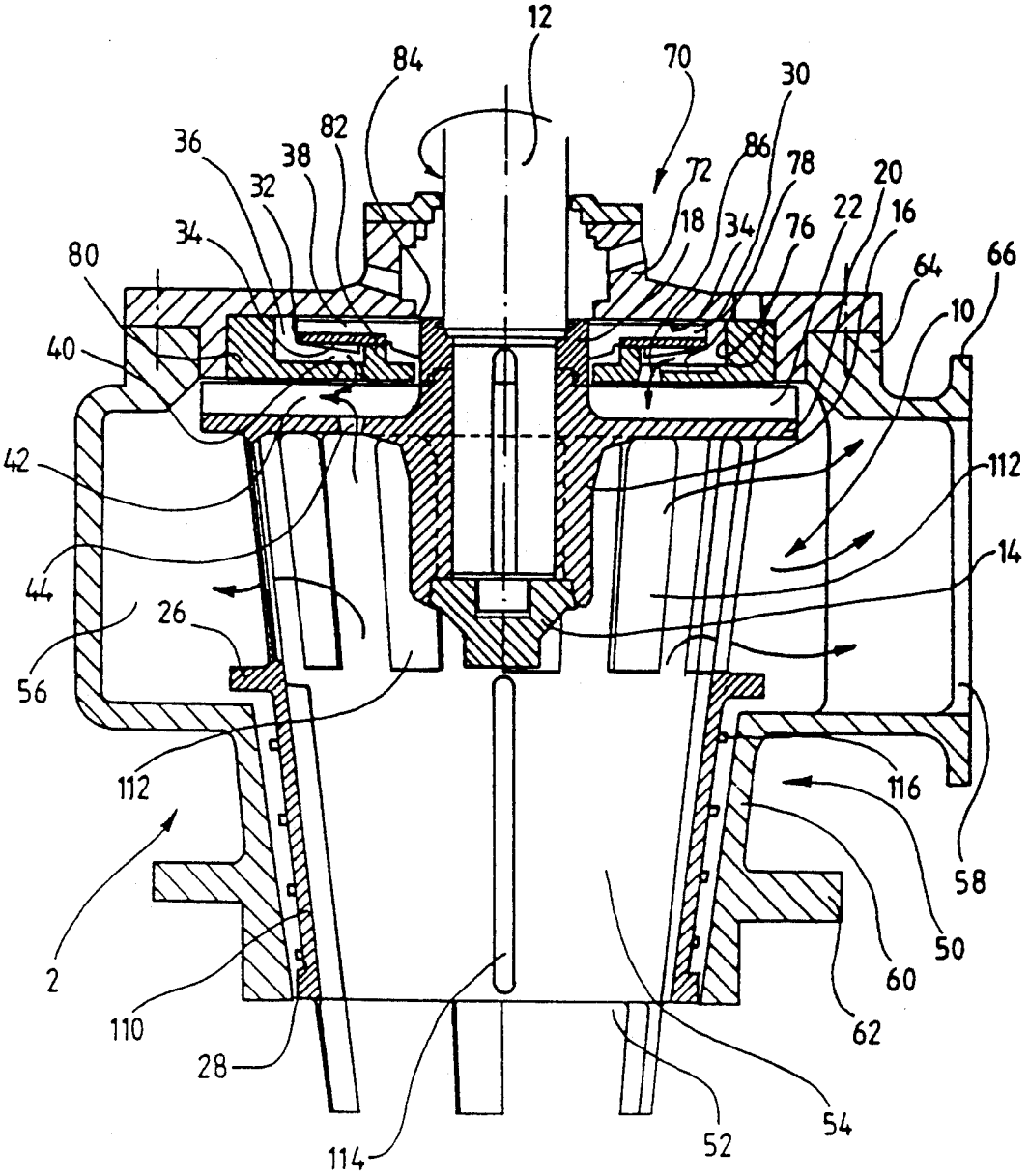
FIG. 5 illustrates a fourth preferred embodiment of the apparatus according to the invention.

Performed test have proved that as to the basic solutions, the gas separator presented in the embodiments of figures 1 to 4 is successful. All the figures illustrate a slightly conical cage provided with blades. Said conical structure has been chosen as an increase in the cross-sectional flow surface from the inlet 52 towards the outlet 58 in the gas separation stage facilitates forming of the gas bubble to the center of the device. However, the most simple solution, and in many respects a structure worth striving for, would be a straight or slightly conical tubular shell 110 illustrated in FIG. 5, in the other end of which, i.e. in the outlet end, close to the flange 20 of the shaft 12 there would be openings 112 via which the pulp could flow due to the centrifugal force to the outlet 58 of the spiral chamber 56. The surface of this kind of a smooth tube must be provided with a few rather low ribs 114 which ensure an adequate rotating velocity of the pulp so as to achieve gas separation. Usually, the height of the ribs can be less than 10% of the diameter of the tubular shell. However, as fibrous pulp is treated the described structure may cause problems if the pressure in the spiral chamber 56 is higher than the pressure in the inlet duct 54 or the pressure in the vessel from which the pulp is discharged to the gas separator. Due to said pressure, the pulp would tend to flow via the slot between the rotor of the separator, in this case the tubular shell 110 and the wall 60 of the casing, back to the pulp space which would result in clogging of said space and at least in unnecessary consumption of energy, not to mention other dangers. This can of course be avoided by providing the outer surface of the tubular shell 110 of the rotor with, for example, a spiral thread 116 which tends to pump the pulp collected in the clearance back to the spiral chamber 56 of the casing 50. Another alternative is to extend the openings 112 over the whole length of the rotor. Thus the function of the elongated openings in the rotor is to create turbulence between the wall 60 of the casing and the tubular shell 110 of the rotor so as to prevent the pulp from collecting there and forming detrimental lumps.

Figure 6:
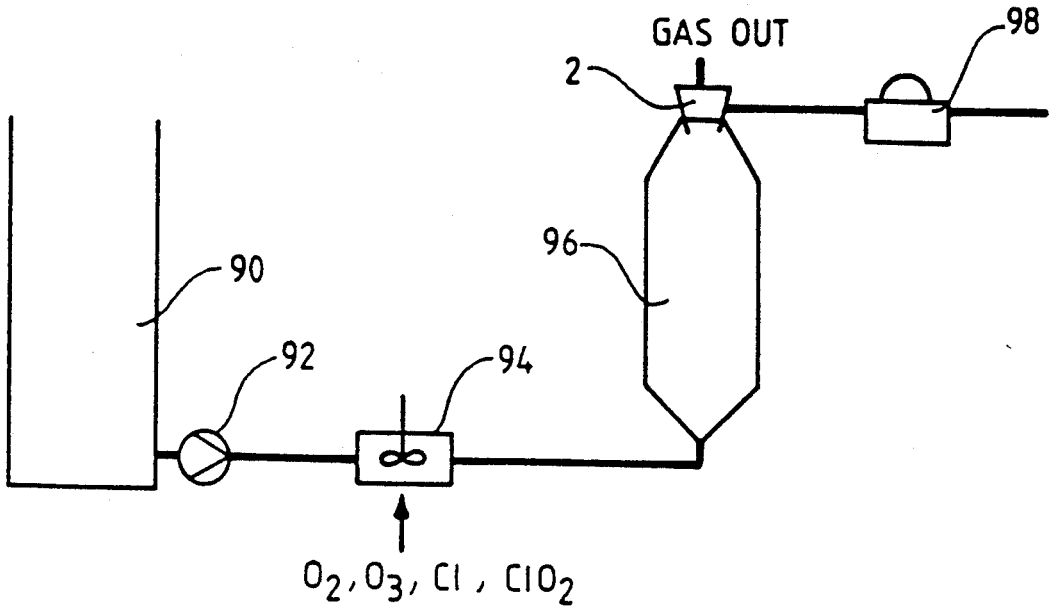
FIG. 6 illustrates a preferred process arrangement of the method according to the invention.

FIG. 6 illustrates an advantageous application of the apparatus according to the invention. The flow-sheet illustrates the flow of pulp pumped by an MC pump 92 from a cellulose store tank 90 via a bleaching chemical (e.g. $O_2$, $O_3$, CL, $ClO_2$) feed mixer 94 to a bleaching tower 96, at the discharge end of which a gas separator 2 according to the invention has been provided. In the embodiment of FIG. 2, the separator 2 advantageously enables the discharge from the tower 96 in such a way that the blades 24 of the rotor 10 extending to the outlet of the tower fluidize the pulp and thus facilitate its discharge to the separator the blades of which in turn raise the pressure of the bleached pulp so that it can be supplied without a separate feeder to a washer 98 which can be either a pressure diffuser or a so-called MC drum washer.

The method of the invention is described in more detail with reference to FIG. 6 according to which the pulp is pumped by pump 92 to a chemical mixer 94, to reactor 96, to a gas separator 2 and to a washer 98. The whole process takes place in a closed space without any contact between air and the pulp. All devices are pressurized and closed. The gas separator partly serves as a pump which raises the pressure of the pulp prior to the washer. The washer is pressurized and closed. The whole process is advantageously carried out at the same consistency, preferably at the range of 8 to 20%.

Part of the apparatus required for carrying out the method already exists and other necessary devices are being continuously developed. The pump 92 for pulp of medium consistency, the so-called MC pump, which is needed in the process is disclosed e.g. in U.S. Pat. No. 4,780,053. Finnish patent application no. 870747 relates to a chemical mixer. A pressurized washer is discussed in patent application Ser. No. 874967. The gas separator, which is essential for the method, has been presented above with reference to FIGS. 1 to 5.

Figure 7:
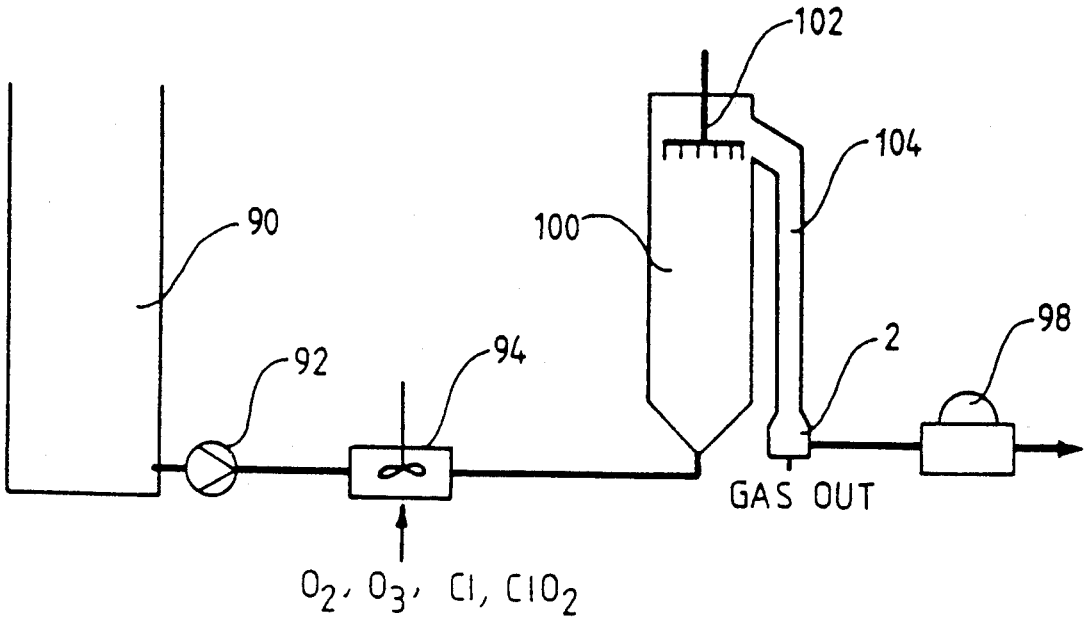
FIG. 7 illustrates another preferred process arrangement of the apparatus according to the invention.

FIG. 7 illustrates a second application of the apparatus according to the invention in which pulp is pumped from an intermediate cellulose store tank 90 by an MC pump 92 via a bleaching chemical (e.g. $O_2$, $O_3$, Cl, $ClO_2$) feed mixer 94 to a bleaching tower 100 the discharge of which is taken care of by means 102 known per se to a drop leg 104 which is preferably provided with a gas separator 2 as illustrated in the embodiment of FIG. 4. Also in this case the separator supplies the pulp directly to a washer. The apparatus according to the invention is applicable not only in pressurized but also in open pressureless processes. It should be noted, of course, that even though only bleaching chemicals are mentioned above other agents used in the treatment of fiber suspension, and agents or organisms possibly used in the future such as enzymes and fungi, are also covered. Thus the word chemical as used in the above description is to be understood in a broader sense than the word "chemical" itself.

As the embodiments described above disclose, a gas separator of a quite new type has been developed which in addition to its main function also efficiently and in an energy-saving manner discharges a bleaching tower, if desired, and feeds pulp directly to a washer. However, it is to be understood that the method and the apparatus according to the present invention is applicable also in many other apparatus which do not necessarily make use of the ability of the device to discharge or pump. Thus the embodiments presented above are not intended to limit the scope of protection of the invention but are to be considered only as examples suggesting a few most advantageous structural alternatives and applications of the invention. The scope of protection covered by the present invention is defined only by the appended patent claims.

We claim:

1. Apparatus for separating gas from cellulose pulp substantially without fluidization of the pulp, comprising:

a casing having an inlet for gas-containing pulp, an outlet for substantially gas free pulp, and a gas outlet;

a shaft mounted for rotation about an axis with respect to said casing and having a flange extending generally perpendicular thereto;

a rotor mounted to said flange for rotation with said flange about said axis of rotation, said rotor comprising a shell having an inside surface and an outside surface, said inside surface closer to said axis of rotation than said outside surface;

means defining a pathway for the flow of pulp into said inlet and out said pulp outlet, said defining means comprising said inside of said shell, and located adjacent said pulp outlet, means defining pulp openings in said shell;

means defining at least one gas opening in said flange to allow gas within said shell to pass through said gas opening ultimately to said gas outlet; said pulp inlet of said casing having an inner surface comprising a surface of revolution; said shell being mounted immediately adjacent said inner surface of said pulp inlet so that substantially no pulp flows into said casing between said outer surface of said shell and said inner surface of said pulp inlet; and a spiral thread formed on said shell outer surface between said shell outer surface and said inner surface of said pulp inlet to facilitate movement of pulp between said shell outer surface and said inner surface of said pulp inlet toward said pulp outlet.

2. Apparatus as recited in claim 1 wherein said shell comprising a plurality of axially elongated and circumferentially spaced blades and a plurality of circumferential rings holding said blades together, and wherein said means defining said pulp openings comprise longitudinal edges of said blades, said openings extending substantially the entire axial length of said shell.

3. Apparatus as recited in claim 2 wherein said plurality of axially elongated blades comprises between 6 and 18 blades.

4. Apparatus as recited in claim 3 wherein at least some of said blades extend outwardly of said casing through said pulp inlet.

5. Apparatus as recited in claim 2 wherein said blades have a cross-section which is substantially the shape of an isosceles triangle, having a narrow tip and a wider base, each blade having the same orientation.

6. Apparatus as recited in claim 2 wherein said blades are tapered inwardly from said flange toward said pulp inlet.

7. Apparatus as recited in claim 1 wherein said shell inner and outer surfaces are conical, having a larger diameter adjacent said flange than adjacent said pulp inlet.

8. Apparatus as recited in claim 1 wherein said pulp outlet has a first dimension parallel to said axis of rotation; and wherein said shell is a solid surface of revolution, except at said openings, said openings having an axial length less than said first dimension, and radially aligned with said first dimension.

9. Apparatus as recited in claim 1 further comprising a plurality of radially elongated blades mounted on said flange within said shell for raising the pressure of pulp within said shell.

10. Apparatus as recited in claim 9 further comprising a plurality of radially extending blades mounted on said flange exteriorly of said shell for moving any pulp that passes through said gas opening in said flange toward said pulp outlet.

11. Apparatus as recited in claim 1 further comprising a plurality of radially extending blades mounted on said flange exteriorly of said shell for moving any pulp that passes through said gas opening in said flange toward said pulp outlet.

12. Apparatus as recited in claim 1 further comprising rib means disposed on said inner surface of said shell for accelerating rotation of pulp moving in said pathway within said shell.

13. Apparatus as recited in claim 1 wherein said flange defines a first gas chamber on a first side thereof, within said shell, and a second gas chamber on a second side thereof, outside said shell, said at least one gas opening in said flange connecting said first and second chambers; and wherein said casing further comprises means defining a third gas chamber connected to said second gas chamber, a plurality of passages extending between said second and third chambers, and said third chamber connected to said gas outlet.

14. Apparatus as recited in claim 13 comprising a radially extending disc disposed in said third gas chamber dividing said third gas chamber into first and second subchambers; a plurality of radially extending blades disposed in each of said subchambers, and rotatable with said shaft; and a plurality of openings leading from said third chamber to said second chamber for the passage of any pulp that might enter said third chamber back into said second chamber.

15. Apparatus as recited in claim 2 wherein said shell has an outer diameter and said blades have a radial thickness, said radial thickness of said blades being less than ten percent of said outer diameter of said shell.

16. Apparatus as recited in claim 1 wherein said inner surface of said pulp inlet is radially spaced from said outer surface of said shell about 5-50 mm.

17. Apparatus as recited in claim 1 wherein pulp flows through said pulp outlet in a direction perpendicular to said axis of rotation of said shaft, and wherein pulp enters said pulp inlet along said axis of rotation of said shaft.

18. A method of treating pulp having a consistency of about 8-20% throughout in a closed, superatmospheric pressure, process, utilizing a first chamber in which the pulp is subjected to rotary movement, a second chamber, and a third chamber; said closed superatmospheric process comprising the steps of sequentially:

(a) mixing treatment chemicals with the pulp;

(b) effecting reaction of the treatment chemicals with the pulp;

(c) separating a major portion of any gases entrained in the pulp from the pulp to produce a degassed pulp;

(d) passing the gases separated from the pulp, without any significant portion of the pulp, out of the superatmospheric pressure process;

(e) passing the degassed pulp to a subsequent treatment stage, and ultimately out of the closed superatmospheric pressure process; and (f) simultaneously with step (c), raising the pressure of the pulp;

wherein step (c) is practiced substantially without fluidization of the pulp by: subjecting the pulp to rotary movement about an axis of rotation; separating a heavier pulp fraction from a lighter, gas-containing, fraction by centrifugal force, the lighter, gas-containing fraction being located closer to the axis of rotation than the heavier pulp fraction; removing gas from the gas-containing fraction, while moving the pulp from the gas-containing fraction toward the heavier fraction so that they mix together forming a degassed pulp; and radially discharging the degassed pulp to move toward the subsequent treatment step; and wherein step (d) is practiced by guiding the lighter material adjacent the axis of rotation to the second chamber; separating pulp fibers from the gas in the second chamber; recirculating the separated pulp fibers to the first chamber; passing the gas separated in the second chamber to the third chamber; separating any fibers still remaining with the gas from the gas in the third chamber; and recirculating any fibers separated from the gas in the third chamber to the second chamber.

19. A method as recited in claim 18 wherein step (e) comprises treatment of the pulp with further treatment chemicals in the subsequent treatment stage.

20. A method as recited in claim 18 wherein step (e) comprises washing the pulp in the subsequent treatment stage.

21. A method as recited in claim 18 comprising a further step of increasing the pressure of the separated fibers in the third chamber.

22. A method of separating pulp fibers from gas entrained in the pulp, utilizing a first chamber in which the pulp is subjected to rotary movement, a second chamber, and a third chamber, the pulp having a consistency of about 8–20%, substantially without fluidization of the pulp, by practicing the steps of: subjecting the pulp to rotary movement about an axis of rotation; separating a heavier pulp fraction from a lighter, gas-containing, fraction by centrifugal force, the lighter, gas-containing fraction being located closer to the axis of rotation than the heavier pulp fraction; removing gas from the gas-containing fraction, while moving the pulp from the gas-containing fraction toward the heavier fraction so that they mix together forming a degassed pulp; and radially discharging the degassed pulp;

wherein the gas is removed from the pulp without any significant amount of pulp fibers, the gas removal being practiced by guiding the lighter material adjacent the axis of rotation to the second chamber; separating pulp fibers from the gas in the second chamber; recirculating the separated pulp fibers to the first chamber; passing the gas separated in the second chamber to the third chamber; separating any fibers still remaining in the gas in the third chamber from the gas; and recirculating any fibers separated from the gas in the third chamber to the second chamber.

23. A method as recited in claim 22 comprising a further step of increasing the pressure of the separated fibers in the third chamber.

24. Apparatus for separating gas from cellulose pulp substantially without fluidization of the pulp, comprising:

a casing having an inlet for gas-containing pulp, an outlet for substantially gas free pulp, and a gas outlet;

a shaft mounted for rotation about an axis with respect to said casing and having a flange extending generally perpendicular thereto;

a rotor mounted to said flange for rotation with said flange about said axis of rotation, said rotor comprising a shell having an inside surface and an outside surface, said inside surface closer to said axis of rotation than said outside surface;

means defining a pathway for the flow of pulp into said inlet and out said pulp outlet, said defining means comprising said inside of said shell, and located adjacent said pulp outlet, means defining pulp openings in said shell;

means defining at least one gas opening in said flange to allow gas within said shell to pass through said gas opening ultimately to said gas outlet;

wherein said shell comprising a plurality of axially elongated and circumferentially spaced blades and a plurality of circumferential rings holding said blades together;

wherein said means defining said pulp openings comprise longitudinal edges of said blades, said openings extending substantially the entire axial length of said shell; and wherein said blades have a cross-section which is substantially the shape of an isosceles triangle, having a narrow tip and a wider base, each blade having the same orientation.

25. Apparatus as recited in claim 24 further comprising means for rotating said shaft in a direction of rotation so that said narrow tip is the leading portion of each blade.

26. Apparatus for separating gas from cellulose pulp substantially without fluidization of the pulp, comprising:

a casing having an inlet for gas-containing pulp, an outlet for substantially gas free pulp, and a gas outlet;

a shaft mounted for rotation about an axis with respect to said casing and having a flange extending generally perpendicular thereto;

a rotor mounted to said flange for rotation with said flange about said axis of rotation, said rotor comprising a shell having an inside surface and an outside surface, said inside surface closer to said axis of rotation than said outside surface;

means defining a pathway for the flow of pulp into said inlet and out said pulp outlet, said defining means comprising said inside of said shell, and located adjacent said pulp outlet, means defining pulp openings in said shell;

means defining at least one gas opening in said flange to allow gas within said shell to pass through said gas opening ultimately to said gas outlet;

wherein said shell comprising a plurality of axially elongated and circumferentially spaced blades and a plurality of circumferential rings holding said blades together;

wherein said means defining said pulp openings comprise longitudinal edges of said blades, said openings extending substantially the entire axial length of said shell; and wherein said blades are tapered inwardly from said flange toward said pulp inlet.

27. Apparatus for separating gas from cellulose pulp substantially without fluidization of the pulp, comprising:

a casing having an inlet for gas-containing pulp, an outlet for substantially gas free pulp, and a gas outlet;

a shaft mounted for rotation about an axis with respect to said casing and having a flange extending generally perpendicular thereto;

a rotor mounted to said flange for rotation with said flange about said axis of rotation, said rotor comprising a shell having an inside surface and an outside surface, said inside surface closer to said axis of rotation than said outside surface;

means defining a pathway for the flow of pulp into said inlet and out said pulp outlet, said defining means comprising said inside of said shell, and located adjacent said pulp outlet, means defining pulp openings in said shell;

means defining at least one gas opening in said flange to allow gas within said shell to pass through said gas opening ultimately to said gas outlet; and wherein said shell inner and outer surfaces are conical, having a larger diameter adjacent said flange than adjacent said pulp inlet.

28. Apparatus for separating gas from cellulose pulp substantially without fluidization of the pulp, comprising:

a casing having an inlet for gas-containing pulp, an outlet for substantially gas free pulp, and a gas outlet;

a shaft mounted for rotation about an axis with respect to said casing and having a flange extending generally perpendicular thereto;

a rotor mounted to said flange for rotation with said flange about said axis of rotation, said rotor comprising a shell having an inside surface and an outside surface, said inside surface closer to said axis of rotation than said outside surface;

means defining a pathway for the flow of pulp into said inlet and out said pulp outlet, said defining means comprising said inside of said shell, and located adjacent said pulp outlet, means defining pulp openings in said shell;

means defining at least one gas opening in said flange to allow gas within said shell to pass through said gas opening ultimately to said gas outlet; and wherein said pulp outlet has a first dimension parallel to said axis of rotation; and wherein said shell is a solid surface of revolution, except at said openings, said openings having an axial length less than said first dimension, and radially aligned with said first dimension.

29. Apparatus for separating gas from cellulose pulp substantially without fluidization of the pulp, comprising:

a casing having an inlet for gas-containing pulp, an outlet for substantially gas free pulp, and a gas outlet;

a shaft mounted for rotation about an axis with respect to said casing and having a flange extending generally perpendicular thereto;

a rotor mounted to said flange for rotation with said flange about said axis of rotation, said rotor comprising a shell having an inside surface and an outside surface, said inside surface closer to said axis of rotation than said outside surface;

means defining a pathway for the flow of pulp into said inlet and out said pulp outlet, said defining means comprising said inside of said shell, and located adjacent said pulp outlet, means defining pulp openings in said shell;

means defining at least one gas opening in said flange to allow gas within said shell to pass through said gas opening ultimately to said gas outlet;

wherein said flange defines a first gas chamber on a first side thereof, within said shell, and a second gas chamber on a second side thereof, outside said shell, said at least one gas opening in said flange connecting said first and second chambers;

wherein said casing further comprises means defining a third gas chamber connected to said second gas chamber, a plurality of passages extending between said second and third chambers, and said third chamber connected to said gas outlet;

a radially extending disc disposed in said third gas chamber dividing said third gas chamber into first and second subchambers; a plurality of radially extending blades disposed in each of said subchambers, and rotatable with said shaft; and a plurality of openings leading from said third chamber to said second chamber for the passage of any pulp that might enter said third chamber back into said second chamber.

* * * * *